US010895025B2

(12) United States Patent
Manos-Gully et al.

(10) Patent No.: US 10,895,025 B2
(45) Date of Patent: Jan. 19, 2021

(54) ARTICLE HAVING A FIRST ZONE WITH FIRST AND SECOND YARNS

(71) Applicant: NIKE, Inc., Beaverton, OR (US)

(72) Inventors: Alexa Manos-Gully, Portland, OR (US); Gagandeep Singh, Beaverton, OR (US); Daren P. Tatler, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 328 days.

(21) Appl. No.: 15/672,562

(22) Filed: Aug. 9, 2017

(65) Prior Publication Data

US 2018/0042333 A1 Feb. 15, 2018

Related U.S. Application Data

(60) Provisional application No. 62/374,550, filed on Aug. 12, 2016.

(51) Int. Cl.

| | |
|---|---|
| ***D04B 1/24*** | (2006.01) |
| ***D04B 1/00*** | (2006.01) |
| ***D04B 1/16*** | (2006.01) |
| ***A43B 1/04*** | (2006.01) |

(52) U.S. Cl.

CPC ..... *D04B 1/24* (2013.01); *A43B 1/04* (2013.01); *D04B 1/00* (2013.01); *D04B 1/16* (2013.01); *D10B 2401/041* (2013.01); *D10B 2501/043* (2013.01)

(58) Field of Classification Search

CPC ... D04B 1/14; D04B 1/22; D04B 1/24; D04B 1/12; D04B 1/123; A43B 1/04

USPC ..... 36/47; 66/177, 171

See application file for complete search history.

(56) References Cited

U.S. PATENT DOCUMENTS

| | | | | |
|---|---|---|---|---|
| 6,116,059 | A * | 9/2000 | Rock | A43B 1/04 66/191 |
| 6,161,400 | A * | 12/2000 | Hummel | A41D 19/01505 66/174 |
| 6,308,438 | B1 | 10/2001 | Throneburg et al. | |
| 6,627,562 | B1 | 9/2003 | Gehring | |
| 8,621,891 | B2 * | 1/2014 | Dua | A43B 23/0245 66/177 |
| 9,725,835 | B2 * | 8/2017 | Vaglio Tessitore | D04B 1/16 |
| 10,458,052 | B2 * | 10/2019 | Adami | B29C 70/44 |

(Continued)

FOREIGN PATENT DOCUMENTS

| | | |
|---|---|---|
| CN | 104246040 A | 12/2014 |
| EP | 1 529 864 A1 | 5/2005 |

(Continued)

OTHER PUBLICATIONS

Honeywell Spectra Physical Properties, (2013), Honeywell International Inc., pp. 1-2 (Year: 2013).*

(Continued)

*Primary Examiner* — Danny Worrell

(74) *Attorney, Agent, or Firm* — Brinks Gilson & Lione

(57) ABSTRACT

The present disclosure provides an article. The article may include a knitted component with a first zone, the first zone being at least partially formed with a first yarn and a second yarn. The first yarn may be a monofilament yarn. The second yarn may have a tenacity of at least 5 grams per denier (g/D). The first yarn and the second yarn may be adjacent at least at one location within the first zone.

17 Claims, 5 Drawing Sheets

(56) References Cited

U.S. PATENT DOCUMENTS

| | | | | |
|---|---|---|---|---|
| 2009/0092830 | A1* | 4/2009 | Chitrangad | D01D 10/02 428/364 |
| 2009/0301139 | A1 | 12/2009 | Kolmes et al. | |
| 2010/0050699 | A1* | 3/2010 | Kolmes | A41B 9/00 66/174 |
| 2012/0246973 | A1* | 10/2012 | Dua | A43B 23/0235 36/83 |
| 2014/0245632 | A1* | 9/2014 | Podhajny | A43B 1/04 36/45 |
| 2014/0245634 | A1* | 9/2014 | Podhajny | A43B 23/0265 36/54 |
| 2014/0310983 | A1* | 10/2014 | Tamm | A43B 23/024 36/83 |
| 2017/0202295 | A1* | 7/2017 | MacGilbert | A43B 1/04 |

FOREIGN PATENT DOCUMENTS

| | | |
|---|---|---|
| FR | 2 116 627 | 7/1972 |
| WO | WO 2005/108054 A2 | 11/2005 |
| WO | WO 2013/148244 A1 | 10/2013 |

OTHER PUBLICATIONS

International Search Report and Written Opinion dated Feb. 12, 2019 for corresponding International Application No. PCT/US2017/046025 (6 pp.).

Decision of the [Taiwan] Intellectual Property Office issued Apr. 9, 2019 for Taiwan Application No. 106127202 (with English translation) (14 pp.).

International Search Report and Written Opinion in corresponding International Application No. PCT/US2017/046025, dated Dec. 1, 2017, 13 pages.

Office Action dated Mar. 19, 2020 for Taiwanese Patent Application No. 106127202, with English translation, 15 pages.

Office Action dated Aug. 11, 2020 in Chinese Patent Application No. 2017800570581, with English translation (9 pages).

* cited by examiner

ARTICLE HAVING A FIRST ZONE WITH FIRST AND SECOND YARNS

RELATED APPLICATION

This application claims priority to U.S. provisional application Ser. No. 62/374,550, filed Aug. 12, 2016, which is incorporated by reference herein in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

DESCRIPTION

In one aspect, the present disclosure provides an article. The article may include a knitted component with a first zone, the first zone being at least partially formed with a first yarn and a second yarn. The first yarn may be a monofilament yarn. The second yarn may have a tenacity of at least 5 grams per denier (g/D). The first yarn and the second yarn may be adjacent at least at one location within the first zone.

The second yarn may have a tenacity of at least 20 grams per denier (g/D).

The first zone may be at least partially formed with a third yarn, the third yarn including a thermoplastic polymer material.

The first zone may be at least partially formed with a third yarn, the third yarn having at least one characteristic being different than the first yarn and the second yarn. The third yarn may have an elasticity that is greater than an elasticity of the first yarn and the second yarn. The third yarn may be substantially formed of polyester.

The article may include a second zone, the second zone having a different yarn composition than the first zone. The second zone may exclude at least one of the first yarn and the second yarn. The article may further include an upper being at least partially defined by the knitted component, where the first zone is at least partially located in a vamp region of the upper, and where the second zone is at least partially located in a throat area of the upper.

In another aspect, an upper for an article of footwear may include a first yarn being a monofilament yarn. The upper may further include a second yarn having a tenacity of at least 5 grams per denier (g/D). The first yarn may be knitted with the second yarn in at least a first zone of the upper.

The second yarn may have a tenacity of at least 20 grams per denier (g/D).

The first zone may be at least partially formed with a third yarn, the third yarn including a thermoplastic polymer material.

The first zone may be at least partially formed with a third yarn, the third yarn having at least one characteristic being different than the first yarn and the second yarn. The third yarn may have an elasticity that is greater than an elasticity of the first yarn and the second yarn. The third yarn may be substantially formed of polyester.

The article may include a second zone, the second zone having a different yarn composition than the first zone. The second zone may exclude at least one of the first yarn and the second yarn. The first zone may be at least partially located in a vamp region of the upper, and the second zone may be at least partially located in a throat area of the upper.

In another aspect, the present disclosure provides a method for forming an article. The method may include knitting a first yarn with a second yarn to form a first zone of the article. The first yarn may be a monofilament yarn. The second yarn may have a tenacity of at least 5 grams per denier (g/D).

The method may include knitting a second zone with a third yarn. The third yarn may have at least one characteristic being different from a characteristic of the first yarn and a characteristic of the second yarn. The second zone may exclude at least one of the first yarn and the second yarn.

DETAILED DESCRIPTION

Figure 1:
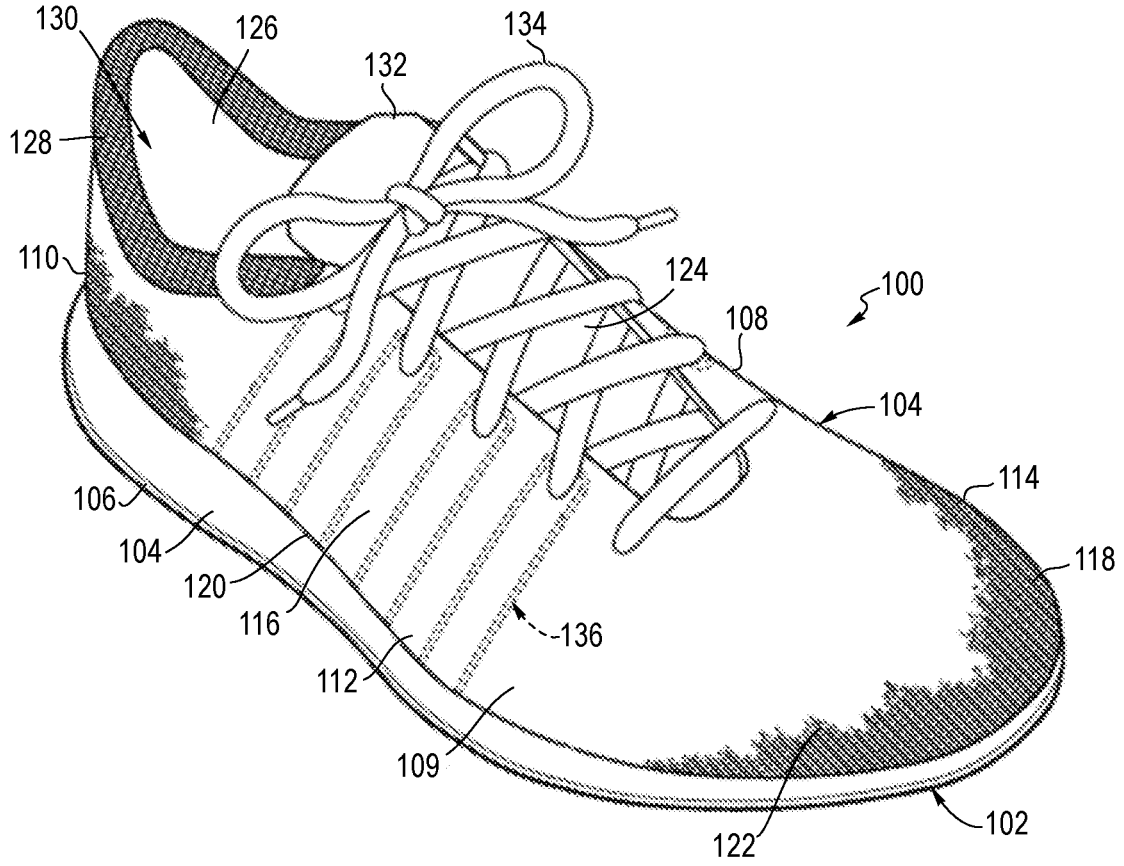
FIG. 1 is a perspective view of an article of footwear incorporating a knitted component.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to uppers configured for use in an article of footwear. The uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic footwear and shoes, such as dress shoes, loafers, and sandals.

With respect to FIG. 1, an example of an article of footwear 100 is generally depicted as including a sole 102 and an upper 108. The upper 108 may include a vamp region 109, a lateral side 112, a medial side 114, a heel region 110, a mid-foot region 116, and a toe region 118. The area of the shoe where the sole 102 joins the outer edge of the upper 108 may be referred to as the biteline 120. The upper 108 may be at least partially formed of a knitted component 122 which may be joined to the sole 102 in a fixed manner using any suitable technique, such as through the use of an adhesive, bonding, sewing, etc.

In some embodiments, the sole 102 may include a midsole 104 and an outsole 106. The article of footwear may additionally include a throat area 124 and an ankle opening 126, which may be surrounded by a collar 128. The upper 108 may define a void 130 of the article of footwear that is configured to receive and accommodate the foot of a user or wearer. The throat area 124 may generally be disposed in the mid-foot region 116 of the upper 108.

In FIG. 1, a tongue 132 is disposed in the throat area 124 of the article of footwear, but the tongue 132 is an optional component, as is the lace 134. Although the tongue 132 depicted in FIG. 1 is a traditional tongue, the tongue 132, if included, may be any type of tongue, such as a gusseted tongue or a burrito tongue. If a tongue is not included, the lateral and medial sides of the throat area 124 may be joined together, for example.

Figure 2:
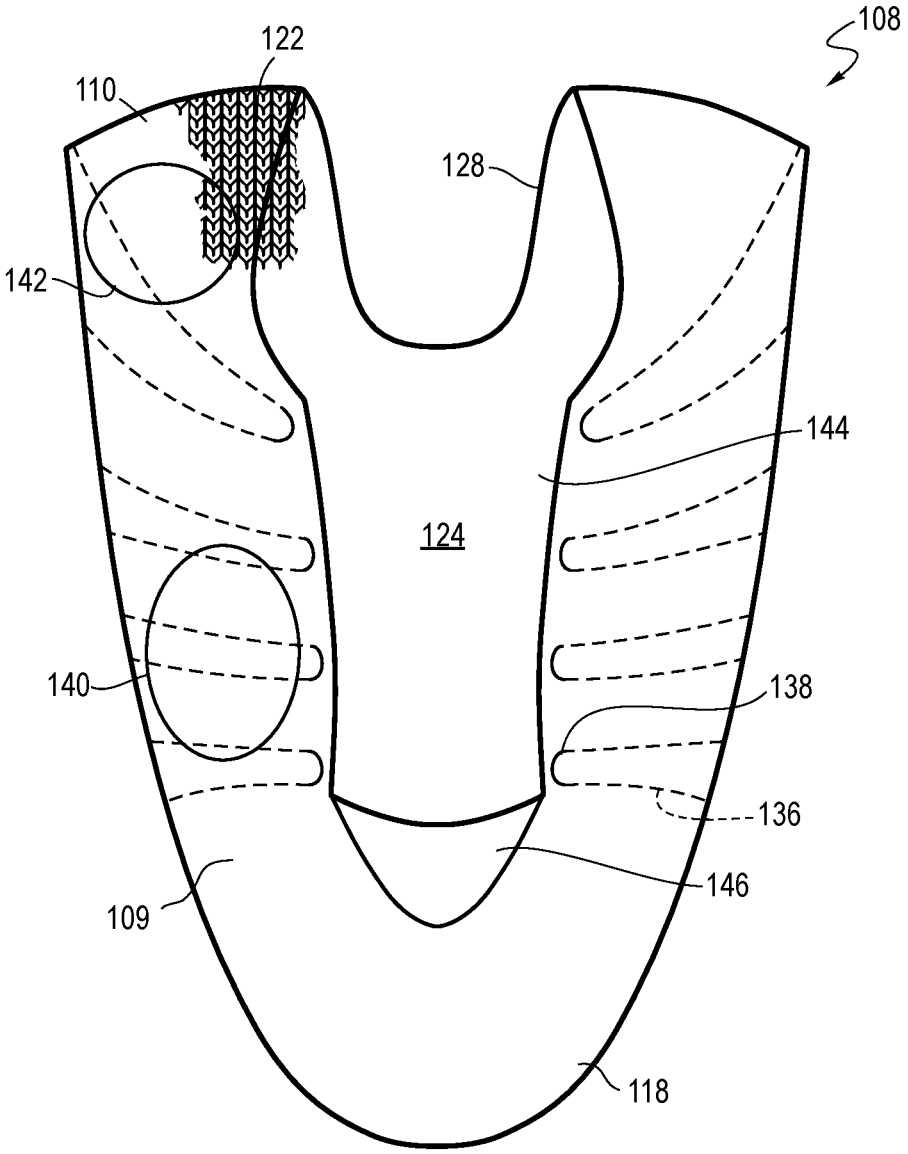
FIG. 2 is a top view of an upper for an article of footwear in accordance with the present disclosure.

In some embodiments, the upper 108 may include one or more tensile strands 136, which may be inlaid within the knitted component 122. Referring to FIG. 2, one or more loops 138 may be formed in the throat area 124 by the tensile strands 136. The tensile strands 136 are an optional component, and may form and/or surround lace apertures in the knitted component 122. The tensile strands 136 may be formed of a yarn, a cable, a rope, or any other suitable elongated element. The tensile strands 136 may be flexible, but it also may have a substantially fixed length measured from a first end to a second end. As such, the tensile strand can be substantially inelastic. The one or more tensile strands 136 may extend across and/or along the upper 108 in any direction. The tensile strands may limit the stretch of the knitted component. The tensile strands 136 may preferably be inlaid within the knitted component 122, but it is contemplated that portions of the tensile strands may be exposed from knitted component. For example, portions of the tensile strands may extend out of the knitted component in the throat region to form the loops 138.

As shown in FIG. 2, the upper 108 may be formed substantially of the knitted component 122. The knitted component 122 may be a continuous and integral knit element. In other words, the knitted component 122 may be manufactured as an integral one-piece element during a single process, such as a single weft knitting process (e.g., with a flat knitting machine or circular knitting machine), a single warp knitting process, or any other suitable knitting or other manufacturing process. Alternatively, the knitted component 122 may be formed of a plurality of individual pieces (where each of the plurality of pieces may be a knit element), and the individual pieces may be assembled together (e.g., by sewing), after the knitting or other manufacturing process. After the knitting process, the upper 108 may go through one or more post-processing steps. For example, in no particular order, the upper 108 may be attached to other elements of the article of footwear (e.g., the sole 102 of FIG. 1), may be placed over a foot-shaped last, and may be steamed or otherwise treated to be formed into its shape for incorporation into a final product (i.e., the article of footwear).

The knitted component 122 may be formed of one or more types of yarn. Herein, a "yarn" shall mean an elongated, continuous length of at least one fiber or strand suitable for use in the production of textiles by hand or by machine, including (but not limited to) textiles made using weaving, knitting, crocheting, braiding, sewing, embroidery, or rope-making techniques. Thread is a type of yarn commonly used for sewing, for example. While yarns can be made using fibers formed of natural, regenerated, and synthetic materials, yarns formed from synthetic polymer fibers are primarily used in manufacturing articles of footwear and performance athletic apparel, as synthetic polymers fibers typically provide the durability and consistency required for these products and for producing them in high volume.

Synthetic polymer fibers are generally formed in continuous strands using techniques such as melt extrusion, reaction spinning, solution dry spinning, and solution wet spinning. The thickness and other cross-sectional characteristics of the synthetic polymer fibers can affect the properties of the fibers and yarns incorporating them. The properties of synthetic polymer fibers (and yarns incorporating them) can also be affected by processes such as drawing (i.e., stretching) the fibers, annealing (i.e., hardening) the fibers, and/or crimping the fibers. The color of the synthetic polymer fibers can be altered by adding pigments or dyes to the polymeric material, for example, before or during fiber formation, or by dyeing the fibers before or after forming them into a yarn. Three basic forms of synthetic polymer fibers are typically used to make yarn: relatively long and continuous filaments; tow, which are formed of many continuous filaments loosely joined side by side; and staple (cut) fibers. The length of synthetic polymer staple fibers typically used to form spun synthetic yarns ranges from about 0.5 inches to about 18 inches in length.

A wide variety of synthetic polymers can be used to form fibers. Commodity polymers commonly used to make fibers include polyesters, such as polyethylene terephthalate (PET); polyamides, such as nylon 6,6, nylon 6, and nylon 12; and polyolefins such as polyethylene and polypropylene. Polyacrylonitrile copolymers are used to make acrylic fibers. Other copolymer such as polyester copolymers and polyamide copolymers can also be used to form synthetic polymer fibers. Elastane, a polyester-polyurethane copolymer, is one such example. Polyurethane (PU), including thermoplastic polyurethane (TPU), can be used to make fibers for use in yarns, and can also be used to coat fibers or yarns formed of other polymeric materials. High performance synthetic polymer fibers can be made from polymeric materials including aramid and ultra-high molecular weight polyethylene (UHMWPE). In addition to one or more types of synthetic polymers, the material used to form the fibers can include pigments or dyes, fillers, processing aids, and the like.

Types of yarn which can be formed using synthetic polymer fibers include filament yarns (including monofilament yarns) and spun yarns. Synthetic polymer filament yarns are formed of continuous elongated filaments which can be twisted or grouped together. Monofilament yarns are formed of a single elongated, continuous filament of a synthetic polymer material. Spun yarns are made by twisting staple fibers together to make a cohesive strand. The process of forming a yarn from staple fibers typically includes carding and drawing the fibers to form sliver, drawing out and twisting the sliver to form roving, and spinning the roving to form a strand. Multiple strands can be plied (twisted together) to make the spun yarn thicker. The twist direction of the staple fibers and of the plies can affect the final properties of the yarn. Synthetic polymer spun yarns can be formed using a single type of fiber, such as a single type of synthetic polymer fiber, by using a blend of more than one type of synthetic polymer fiber, as well as by using blends of one or more type of synthetic polymer fibers with natural and/or regenerated fibers. Similarly, synthetic polymer continuous filament yarns can be formed from continuous filaments of a single type of synthetic polymer, can be formed from continuous filaments formed from more than one type of synthetic polymer, or can be formed from a combination of continuous fibers formed from a regenerated material with synthetic polymer continuous filaments formed of one or more types of synthetic polymers. Once formed, filament and spun yarns can undergo further treatments such as dyeing, texturizing, or coating with a material such as a synthetic polymer, in order to alter the properties of the yarn.

One way to characterize a yarn is based on its mass density or weight per unit length. The linear mass density or weight per unit length of a yarn can be expressed using various units, including denier (D) and tex. Denier is the mass in grams per 9000 meters. The linear mass density of a single filament of a fiber can also be expressed using denier per filament (DPF). Tex is the mass in grams per 1000 meters; decitex (dtex) is the mass in grams per 10,000 meters.

As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, Mass., USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities generally have tenacities in the range of about 5 g/D to about 10 g/D. For example, commercially available package dyed polyethylene terephthalate filament yarn from National Spinning (Washington, N.C., USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, N.C., USA) and Spectra (Honeywell-Spectra, Colonial Heights, Va., USA).

Yarns may include a material with at least one property that changes in response to a stimulus (e.g., temperature, moisture, sweat, electrical current, light, etc.). For example, a yarn may be partially or substantially formed of a thermoplastic polymer material. Illustrative, non-limiting examples of thermoplastic polymer materials include polyurethanes, polyamides, polyolefins, and nylons. Thermoplastic polymer materials may melt when heated and return to a solid state when cooled. More particularly, thermoplastic polymer material transitions from a solid state to a softened or liquid state when subjected to temperatures at or above its melting point, and then the thermoplastic polymer transitions from the softened or liquid state to a solid state when sufficiently cooled below its melting point.

In some embodiments, a yarn may include a thermoplastic polymer sheath and a core formed of another material such as polyester. The thermoplastic polymer material of the sheath may have a melting temperature less than the melting temperature or decomposition temperature of the core. For example, the melting temperature of the thermoplastic polymer material may have a melting temperature of approximately 100° C. less than the melting temperature of the core in some embodiments, though any other suitable difference in melting temperatures is contemplated. In one non-limiting example, the melting temperature of the core may be about 260° C. (and when the core is formed of a thermoset material, the decomposition temperature may be about 350° C. or greater), while the melting temperature of the thermoplastic polymer material may be between about 80° C. and about 140° C. (such as from about 100° C. to about 125° C.) based on atmospheric pressure at sea level.

Further, yarns may include one or more elastomeric filaments to provide the yarn with a particular degree of elasticity. Elastic filaments may include, for example, latex, spandex, or elastane (which are often referred to as Lycra). A fiber of elastic material (e.g., a fiber of spandex) may be stretched to twice its unstretched length, 4 times its unstretched length, or even 8 times or more its unstretched length without rupturing. When incorporated into a yarn (which may additionally include other materials, such as polyester), the elastomeric filaments may provide the yarn with elasticity such that the yarn has the ability to elongate (i.e., increase in length) without rupturing when subjected to a tensile force and then recover to its original length when relieved from the tensile force.

Some yarns, such as monofilament yarns made of a single filament of an inelastic synthetic polymer material, may have substantially no, or very little, elasticity. For example, a monofilament yarn made of an inelastic synthetic polymer material may have maximum elongation of less than 5% (e.g., the maximum length of the yarn when subjected to a tensile force approaching its breaking force is less than 5% of its length when not subjected to a tensile force), and it is contemplated that a such a yarn could have a maximum elongation of 1%, 0.5%, or even less. Other yarns, such as yarns formed of textured polyester, may have a maximum elongation of between about 20% and about 40%. A yarn incorporating spandex (with or without other materials), for example, may have a maximum elongation of 100%, 200%, 300%, or more.

Referring to FIG. 2, the knitted component 122 may include two or more zones, where each zone includes a different yarn composition and/or a different knit structure. For example, a first zone 140 may be in the mid-foot region 116 (and in a vamp region as shown) of the upper 108. The first zone 140 may include a first yarn and a second yarn, which may be adjacent and/or knitted with one another in the first zone 140. Herein, the "first yarn" and "second yarn" (as well as subsequent yarns) may refer to one or more ends of a particular yarn type (or multiple types), and they may include a single continuous strand or multiple strands. For example, the first yarn may include a high tenacity yarn and may have a tenacity in the range of about 5 g/D to about 10 g/D, or higher (such as 20 g/D or higher). The depicted second yarn may include a monofilament yarn, for example. The inventors have found that the combination of a high tenacity yarn (i.e., the first yarn) and a monofilament yarn (i.e., the second yarn) in a particular zone (i.e., the first zone 140) has particular advantages. For example, on its own, a high tenacity yarn is generally relatively strong but limber, while a monofilament yarn generally relatively rigid but weak when compared to the high tenacity yarn. When utilized together (e.g., knitted together) in a zone of a knitted component, the two yarns together may provide the zone with the desirable characteristics of both (e.g., rigidity and strength).

The first zone 140 may also include a third yarn, which may be a different type of yarn from the first yarn and the second yarn. In some embodiments, the third yarn may be a yarn incorporating a thermoplastic polymer material and/or another material reactive to a stimulus. The thermoplastic polymer material, for example, may be configured to form a fused area when subjected to a sufficient amount of heat during a heating process such that the thermoplastic polymer material displaces and/or forms a bond between one or more yarns in the first zone 140. This may add rigidity to the first zone 140, for example, as well as provide other advantageous characteristics to the knitted component (e.g., water resistance and water repellence).

The first zone 140 may additionally or alternatively include a fourth yarn, for example. The fourth yarn may have at least one characteristic that is different from the characteristics in the other yarns of the first zone 140. For example, the fourth yarn may have a relatively high elasticity when compared to the other yarns. In one embodiment, the fourth yarn may have a maximum elongation of at least 50%, at least 100%, at least 200%, at least 300%, or even more. Similarly, fifth yarn may be included. The fifth yarn may have a characteristic different than the characteristics of the other yarns in the first zone 140. For example, the fifth yarn may be a spun yarn formed primarily of polyester. Advantageously, the fifth yarn may provide the upper 108 with properties suitable for contacting the foot or a wearer, for example inside the void 130 (see FIG. 1). The fifth yarn may additionally or alternatively provide the first zone 140 with one or more colors, patterns, or other visual characteristics to provide the upper 108 with pleasing aesthetic properties.

The knitted component 122 may include a second zone 142, which may be at least partially located in the heel region 110 of the upper 108 and may differ in yarn composition from the first zone 140. For example, the second zone 142 may include the first, second, fourth, and fifth yarns, but may exclude the third yarn (which has a thermoplastic polymer material). This may be advantageous where the thermoplastic polymer material is desired only at select locations of the upper 108 to achieve certain properties at those locations (like suitable rigidity).

For example, a third zone 144 may include only the fourth yarn, where the fourth yarn has a relatively high elasticity. This may be advantageous when it is desirable for different areas of the upper 108 to exhibit different characteristics. For example, when the third zone 144 is located substantially in the throat area 124 of the upper 108 and/or in the area adjacent to the collar 128, the relatively elastic third zone 144 may provide the upper 108 with a snug and comfortable fit around the foot of a wearer as well as the ability to receive the foot with relative ease due to the elasticity of the collar. The third zone 144 may further have the capability of interacting with a lace or other securement device such that the fit of the upper 108 may be adjusted. The third zone 144 is not limited to only the fourth yarn. For example, it is contemplated that the third zone 144 could have to or more (e.g., all) of the yarns that form the first zone 140, but with a different frequency than that of the first zone 140. The third zone 144 may additionally or alternatively include one or more yarns that are absent from the first zone 140.

A fourth zone 146 may additionally or alternatively be included. The fourth zone may differ in yarn composition from at least one of the first zone 140 and the third zone 144. For example, the fourth zone may include the fifth yarn, but substantially exclude at least one of, and potentially all of, the first yarn, the second yarn, the third yarn, and the fourth yarn. This may be advantageous for providing suitable characteristics associated with the fifth yarn to the toe region 118 of the upper 108.

The first zone 140, second zone 142, third zone 144, and fourth zone 146 are provided only as examples, and the knitted component 122 is not limited to only four zones. Any suitable number of zones may be included, including more than three zones. It is contemplated that the zones may not be distinguishable visually, but in some embodiments the zones are placed to provide an upper 108 having desirable visual characteristics as well as desirable functional characteristics.

Figure 3:
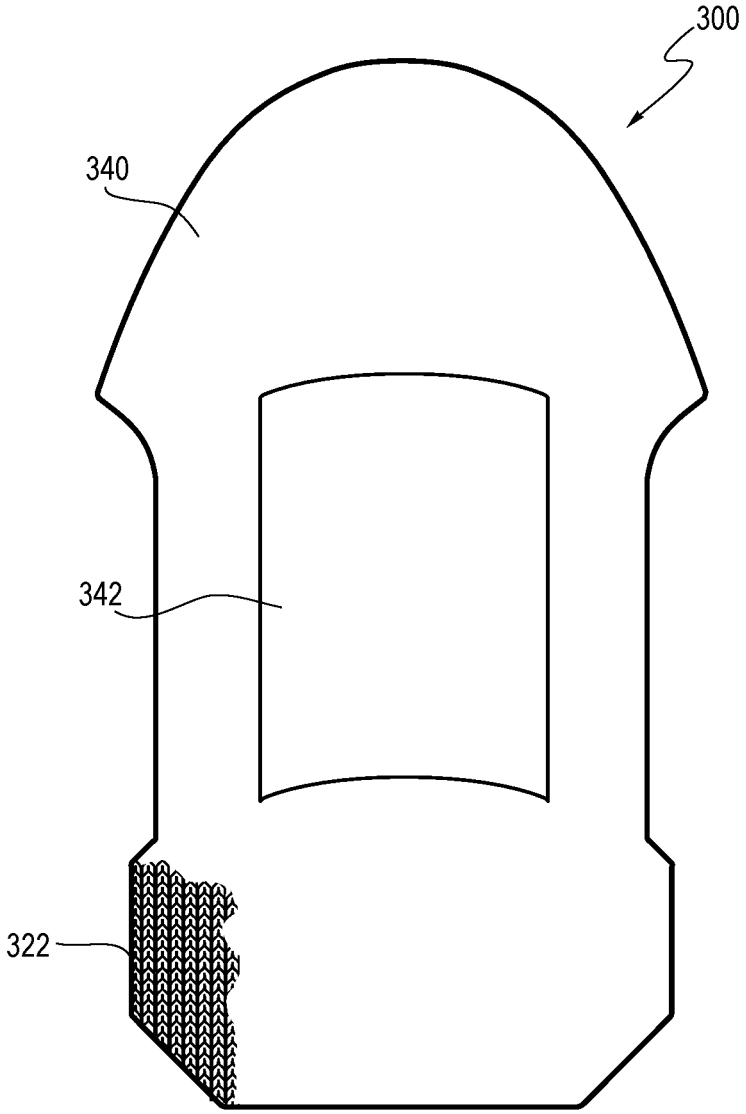
FIG. 3 is a top view of an article incorporating a knitted component in accordance with the present disclosure.

FIG. 3 shows an alternative article 300. The article 300 may be a portion of an upper, or it may be another article, such as an article of apparel. In one embodiment, the article 300 is formed of a knitted component 322, and is configured to define the toe region and the tongue of an upper. A second portion (not shown) may form the remainder of the upper. The article 300 and the described second portion may be attached by sewing, with a mechanical device (e.g., a tack or clamp), with an adhesive, or by any other suitable technique. The article 300 may have two zones: a first zone 340 and a second zone 342. Similar to as described above with respect to the zones of FIG. 2, the first zone 340 and the second zone 342 may have different yarn compositions such that they exhibit different characteristics suitable for particular areas of the article 300. Alternatively, the first zone 340 and the second zone 342 may have identical or similar yarn compositions, but the knit structure may vary to provide varying characteristics.

Figure 4:
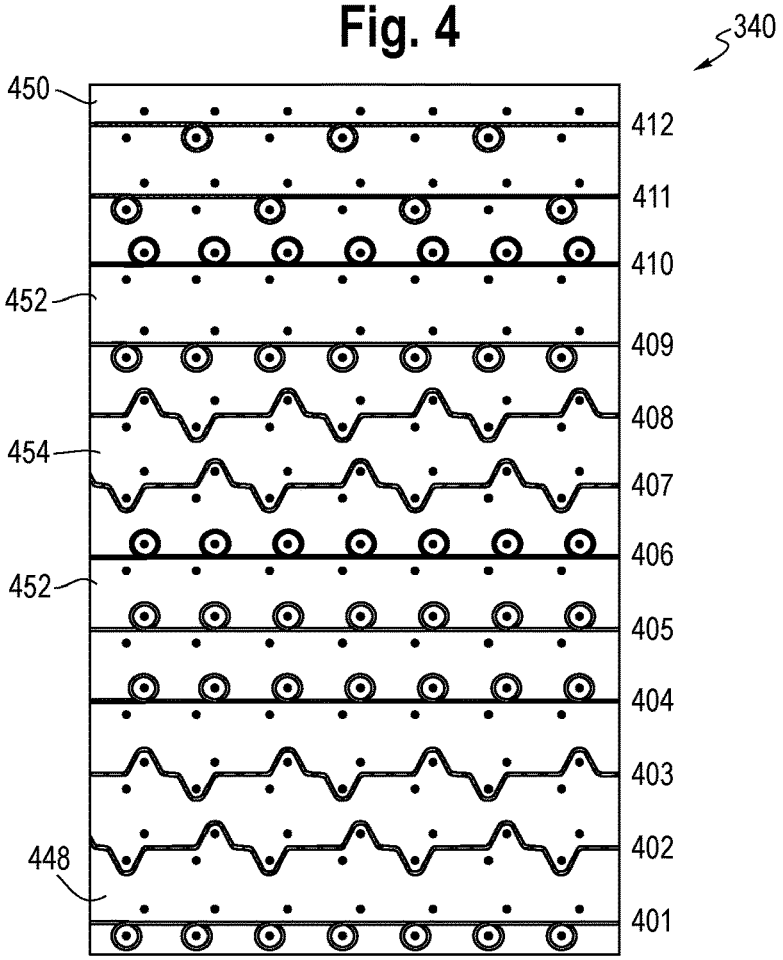
FIG. 4 is a knit diagram illustrating a sequence in accordance with the present disclosure.
Figure 5:
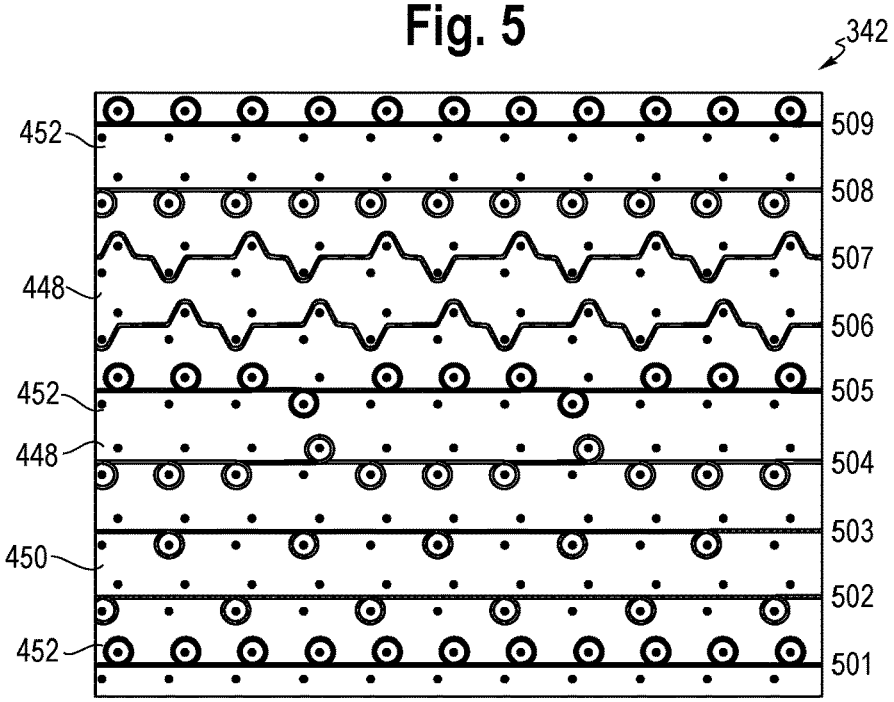
FIG. 5 is a knit diagram illustrating a second sequence in accordance with the present disclosure.

For example, the first zone 340 may be formed using the knit sequence depicted by FIG. 4, and the second zone may be formed using the knit sequence depicted by FIG. 5. Referring to FIG. 4, the first zone 340 may include a first yarn 448, a second yarn 450, and a third yarn 452. Each of the yarns may be multiple ends of one or more types of yarn, for example. The first yarn 448 may include a high-tenacity yarn, the second yarn 450 may include a monofilament yarn, and the third yarn 452 may include a spun yarn formed primarily of polyester or another material. The steps 401-412 of FIG. 4 are shown as a non-limiting example one suitable knitting process on a flat knitting machine with a front needle bed and a back needle bed.

The first step 401 of FIG. 4 involves a knit on every needle of the back bed with the first yarn 448. In a second step 402, the first yarn 448 may be tucked on every other needle of the front and back beds, and the third step 403 may involve doing the same (but offset from the second step 402). In the fourth step 404, the first yarn 448 is knit on every other needle of the back bed. In the fifth step 405, the first yarn 448 is knit on every other needle of the back bed (but offset from the fourth step 404). In the sixth step 406, the third yarn 452 is knit on every needle of the back bed. The seventh step 407 involves tucking the first yarn 448 on every other needle of the front and back beds, and the eighth step 408 involves doing the same (but offset from the seventh step 407). In a ninth step 409, the first yarn 448 may be knit on every needle of the back bed. In a tenth step 410, the third yarn 452 may be knit on every needle of the back bed. In an eleventh step 411, the second yarn 450 may be knit on every other needle of the front bed. In a twelfth step 412, the second yarn 450 may be knit on every other needle of the front bed of a flat knitting machine (but offset from the eleventh step 411). The sequence may be repeated as necessary (and each repetition may be offset or otherwise altered).

Referring to FIG. 5, the second zone 342 (see also FIG. 3) may have a sequence different than the sequence of the first zone 340 such that the first zone 340 and the second zone 342 have different knit structures exhibiting different properties. In a first step 501, a knit may occur on every needle of the back bed with the third yarn 452. The second step 502 may involve a knit on every other needle of the front bed with the second yarn 450. The third step 503 may involve a knit on every other needle of the front bed with the second yarn 450 (but offset from the second step 502). In a fourth step 504, the first yarn 448 may be knit on three consecutive needles on the front bed before skipping a needle (which may be repeated), while skipping three needles on the back bed before forming a knit (which may be repeated). The fifth step 505 may involve the inverse sequence with respect to the fourth step 504, but with the third yarn 452. In a sixth step 506, the first yarn 448 may be tucked on every other needle of the front bed and the back bed. In a seventh step 507, the first yarn 448 may be tucked on every other needle of the front bed and the back bed (but offset from the sixth step 506). In an eighth step 508, the first yarn 448 may be knit on every needle of the front bed. In the last step 509, the third yarn 452 may be knit on every needle of the back bed. The sequence may be repeated as necessary (and each repetition may be offset or otherwise altered).

Figure 6:
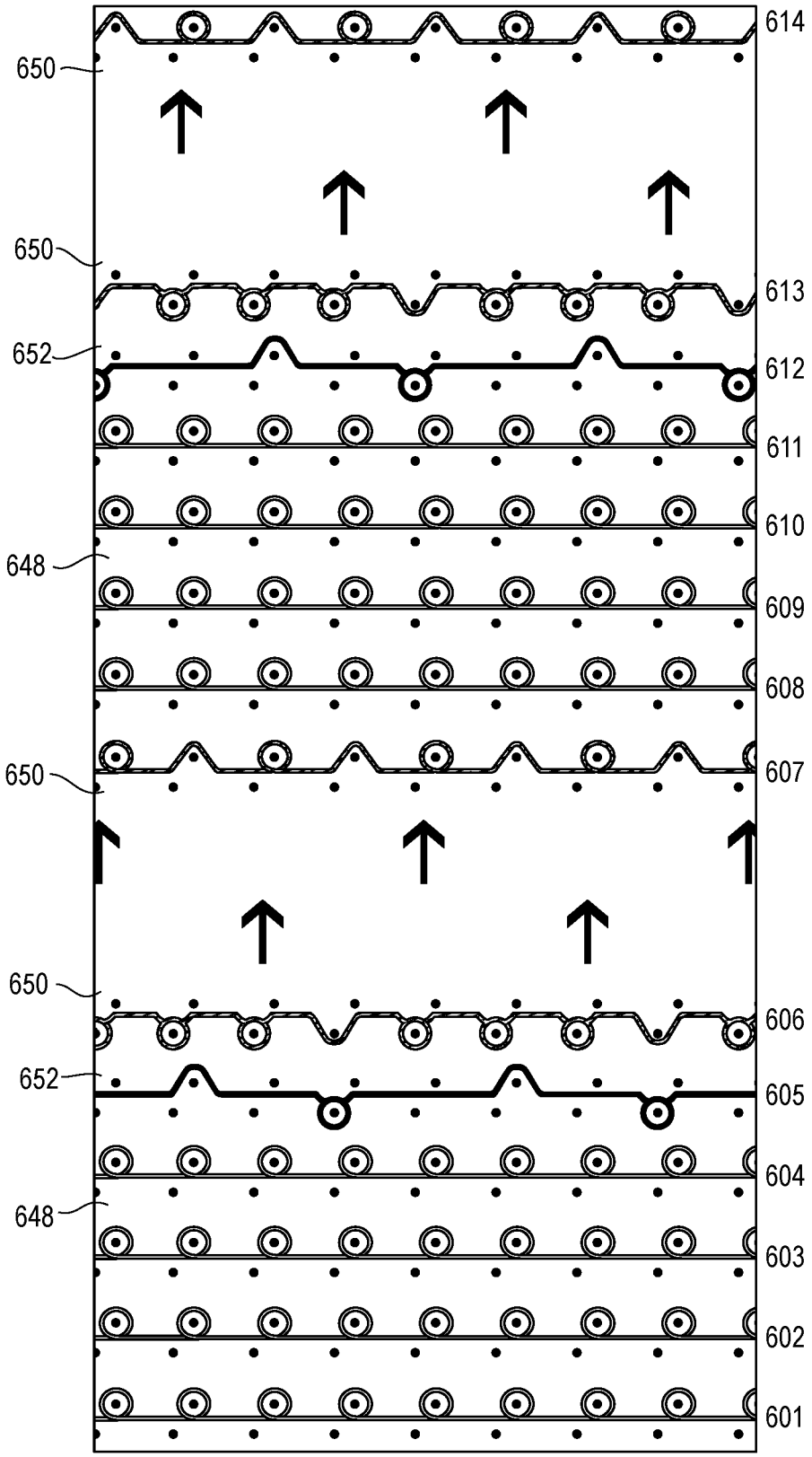
FIG. 6 is a knit diagram illustrating a third sequence in accordance with the present disclosure.

In another embodiment, the sequence of FIG. 6 may be used to form an article having a first yarn 648, a second yarn 650, and a third yarn 652. This sequence may be suitable for forming at least a portion of an upper (e.g., the upper 108 of FIG. 2). The first yarn 648 may include, for example, an end of monofilament yarn. The second yarn 650 may be a high tenacity yarn, and the third yarn may be a yarn with a relatively high elasticity. A yarn incorporating a thermoplastic polymer material may additionally or alternatively be included (potentially with one of the first yarn 648, second yarn 650, or third yarn 652).

Steps 601-604 may involve knitting four passes of the first yarn 648 on the back bed. In the fifth step 605, the third yarn 652 may be knit on every fourth needle of the front bed and tucked on every fourth needle of the back bed. In a sixth step 606, the second yarn 650 may be knit on three consecutive needles and then tucked on one needle of the front bed (which may be repeated). After the sixth step, transfers may take place as shown in FIG. 6. In a seventh step 607, a knit and tuck may be alternated on the back bed with the second yarn 650. The preceding steps may then be repeated in steps 608-614 as depicted (and potentially offset, as shown).

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. An article of footwear, the article of footwear comprising:

an upper at least partially formed with a knitted component, the knitted component having a first zone, the first zone being at least partially formed with a first yarn and a second yarn;

the first yarn being a monofilament yarn; and the second yarn being a multi-filament yarn and having a tenacity of at least 5 grams per denier (g/D), wherein the second yarn includes a course within the first zone that has a first plurality of loops that alternate with a second plurality of loops, wherein the first yarn and the second yarn are knitted together such that they extend together through the first yarn engages the first plurality of loops; and wherein the first yarn floats past each of the second plurality of loops.

2. The article of footwear of claim 1, wherein the second yarn has a tenacity of at least 20 grams per denier (g/D).

3. The article of footwear of claim 1, wherein the first zone is at least partially formed with a third yarn, the third yarn including a thermoplastic polymer material.

4. The article of footwear of claim 1, wherein the first zone is at least partially formed with a third yarn, the third yarn having at least one characteristic being different than the first yarn and the second yarn.

5. The article of footwear of claim 4, wherein the third yarn has an elasticity that is greater than an elasticity of the first yarn and the second yarn.

6. The article of footwear of claim 4, wherein the third yarn is substantially formed of polyester, and wherein the third yarn is knitted such that it engages the second plurality of loops.

7. The article of footwear of claim 1, further comprising a second zone, the second zone having a different yarn composition than the first zone.

8. The article of footwear of claim 7, wherein the second zone excludes at least one of the first yarn and the second yarn.

9. The article of footwear of claim 7, further comprising an upper being at least partially defined by the knitted component, wherein the first zone is at least partially located in a vamp region of the upper, and wherein the second zone is at least partially located in a throat area of the upper.

10. An upper for an article of footwear, the upper comprising:

a first yarn being a monofilament yarn; and a second yarn being a multi-filament yarn and having a tenacity of at least 5 grams per denier (g/D), wherein the first yarn is knitted with the second yarn in at least a first zone of the upper such that the first yarn and the second yarn are knitted together via at least one loop of a knitted course, wherein the first zone is at least partially formed with a third yarn, the third yarn including a thermoplastic polymer material, and wherein the thermoplastic polymer material forms a bond between the first yarn and the second yarn.

11. The upper of claim 10, wherein the first zone is at least partially formed with a third yarn, the third yarn having at least one characteristic being different than the first yarn and the second yarn.

12. The upper of claim 11, wherein the third yarn has an elasticity that is greater than an elasticity of the first yarn and the second yarn.

13. The upper of claim 11, wherein the third yarn is substantially formed of polyester.

14. The upper of claim 10, further comprising a second zone, the second zone having a different yarn composition than the first zone.

15. The upper of claim 14, wherein the second zone excludes at least one of the first yarn and the second yarn.

16. The upper of claim 14, wherein the first zone is at least partially located in a vamp region of the upper, and wherein the second zone is at least partially located in a throat area of the upper.

17. The upper of claim 10, wherein the second yarn has a tenacity of at least 20 grams per denier (g/D).

* * * * *